US012693041B2

(12) United States Patent
Mota

(10) Patent No.: US 12,693,041 B2
(45) Date of Patent: Jul. 28, 2026

(54) ADJUSTABLE VENT COVER APPARATUS AND METHOD

(71) Applicant: Jovanny Mota, Camden, NJ (US)

(72) Inventor: Jovanny Mota, Camden, NJ (US)

( * ) Notice: Subject to any disclaimer, the term of this patent is extended or adjusted under 35 U.S.C. 154(b) by 386 days.

(21) Appl. No.: 18/534,937

(22) Filed: Dec. 11, 2023

(65) Prior Publication Data

US 2025/0189167 A1 Jun. 12, 2025

(51) Int. Cl.
*F24F 13/20* (2006.01)
*F24F 13/08* (2006.01)

(52) U.S. Cl.
CPC ..... *F24F 13/20* (2013.01); *F24F 13/084* (2013.01)

(58) Field of Classification Search
CPC ..... F24F 13/20; F24F 13/084; F24F 13/0254
See application file for complete search history.

(56) References Cited

U.S. PATENT DOCUMENTS

| | | | | |
|---|---|---|---|---|
| 4,803,603 | A * | 2/1989 | Carson | F21V 21/04 362/404 |
| 6,176,599 | B1 * | 1/2001 | Farzen | F21V 29/15 362/147 |
| 10,712,046 | B2 * | 7/2020 | Gao | F24F 13/32 |
| 2005/0003754 | A1 * | 1/2005 | Pilger | F24F 13/02 454/292 |
| 2022/0018523 | A1 * | 1/2022 | Vinh | F21V 21/04 |
| 2022/0316690 | A1 * | 10/2022 | Wong | F21V 21/108 |
| 2024/0369209 | A1 * | 11/2024 | Menendez | F21V 21/15 |
| 2026/0002663 | A1 * | 1/2026 | Portinga | F21V 29/503 |

* cited by examiner

*Primary Examiner* — Allen R. B. Schult
*Assistant Examiner* — Amy E Carter
(74) *Attorney, Agent, or Firm* — Walter J. Tencza, Jr.

(57) ABSTRACT

A first device having first and second openings, and a first track between the first and second openings; second and third devices, each of which includes an elongated rail. The first device is configured so that a first end of the rail of the second device can be inserted into the first opening of the first device, so that a majority of the rail of the second device lies within the first track of the first device, while a first end of the rail of the third device is configured to be inserted into the second opening of the first device, so that a majority of the rail of the third device lies with the first track of the first device and interlocks with the rail of the second device. Each of the second and third devices include a plate configured to be fixed to first and second structural members.

18 Claims, 10 Drawing Sheets

ADJUSTABLE VENT COVER APPARATUS AND METHOD

FIELD OF THE INVENTION

This invention relates to devices for vent covers and caps.

BACKGROUND OF THE INVENTION

There are various devices and methods related to vent covers and caps.

SUMMARY OF THE INVENTION

In at least one embodiment of the present invention, an apparatus is provided comprising: a first device having first and second openings, and a first track between the first and second openings of the first device; a second device, which includes an elongated rail; and a third device, which includes an elongated rail.

In at least one embodiment of the present invention, the first device is configured so that a first end of the rail of the second device is configured to be inserted into the first opening of the first device, so that a majority of the rail of the second device lies within the first track of the first device, while a first end of the rail of the third device is configured to be inserted into the second opening of the first device, so that a majority of the rail of the third device lies with the first track of the first device and interlocks with the rail of the second device.

The second device may include a plate fixed to a second end of the rail of the second device opposite the first end of the rail of the second device; and the third device may include a plate fixed to a second end of the rail of the third device opposite the first end of the rail of the third device.

In at least one embodiment, the plate of the second device has an opening through which a fastener is configured to be inserted to fix the plate of the second device to a member; and the plate of the third device has an opening through which a fastener is configured to be inserted to fix the plate of the second device to a member.

In at least one embodiment, the apparatus may be further comprised of a fourth device, which includes an elongated rail; and a fifth device, which includes an elongated rail.

The first device may be configured so that a first end of the rail of the fourth device is configured to be inserted into a third opening of the first device, so that a majority of the rail of the fourth device lies within a second track of the first device, while a first end of the rail of the fifth device is configured to be inserted into a fourth opening of the first device, so that a majority of the rail of the fifty device lies with the second track of the first device and interlocks with the rail of the fourth device. The first track of the first device may be substantially parallel to the second track of the first device.

The first device may further include a third track and a fourth track; wherein the third track is substantially parallel to the fourth track and substantially perpendicular to the first and second tracks; wherein the first device is configured so that a first end of the rail of the second device is configured to be inserted into a fifth opening of the first device, so that a majority of the rail of the second device lies within the third track of the first device, while a first end of the rail of the third device is configured to be inserted into a sixth opening of the first device, so that a majority of the rail of the third device lies with the third track of the first device and interlocks with the rail of the second device, while a first end of the rail of the fourth device is configured to be inserted into a seventh opening of the first device, so that a majority of the rail of the fourth device lies within the fourth track of the first device, while a first end of the rail of the fifth device is configured to be inserted into an eighth opening of the first device so that a majority of the rail of the fifth device lies within the fourth track of the first device and interlocks with the rail of the fourth device.

The first device may have a rectangular periphery, and may be made of plastic, while the second, third, fourth, and fifth devices may be made of metal.

In at least one embodiment, the fourth device may include a plate fixed to a second end of the rail of the fourth device opposite the first end of the rail of the fourth device; and the fifth device may include a plate fixed to a second end of the rail of the fifth device opposite the first end of the rail of the fifth device; wherein the plate of the fourth device has an opening through which a fastener is configured to be inserted to fix the plate of the fourth device to a member; and wherein the plate of the fifth device has an opening through which a fastener is configured to be inserted to fix the plate of the fifth device to a member.

In at least one embodiment, a method is provided which may include fixing a first device to first and second structural members by use of second and third devices and/or by use of fourth and fifth devices, wherein the first, second, third, fourth, and fifth devices are configured in one or more embodiments as previously discussed.

DETAILED DESCRIPTION OF THE DRAWINGS

Figure 1:
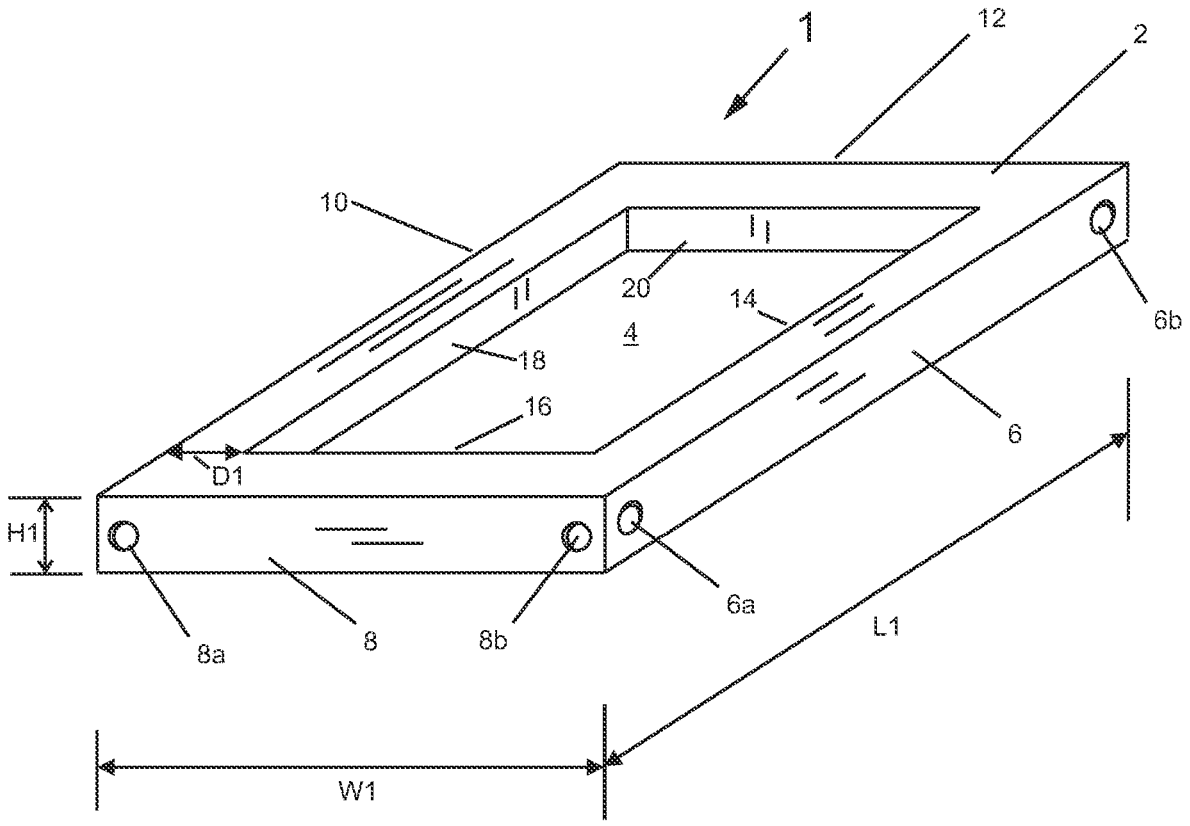
FIG. 1 shows a top, front, and right perspective view of a first device for use in accordance with an embodiment of the present invention.
Figure 2:
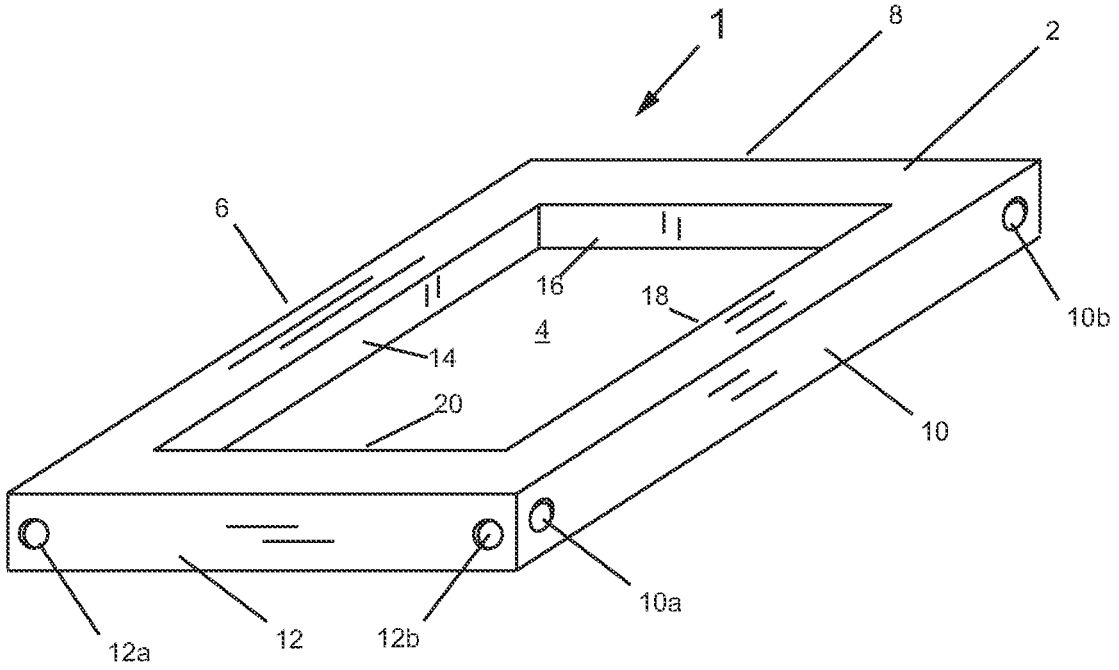
FIG. 2 shows a top, rear, and left perspective view of the first device for use in accordance with an embodiment of the present invention.
Figure 3:
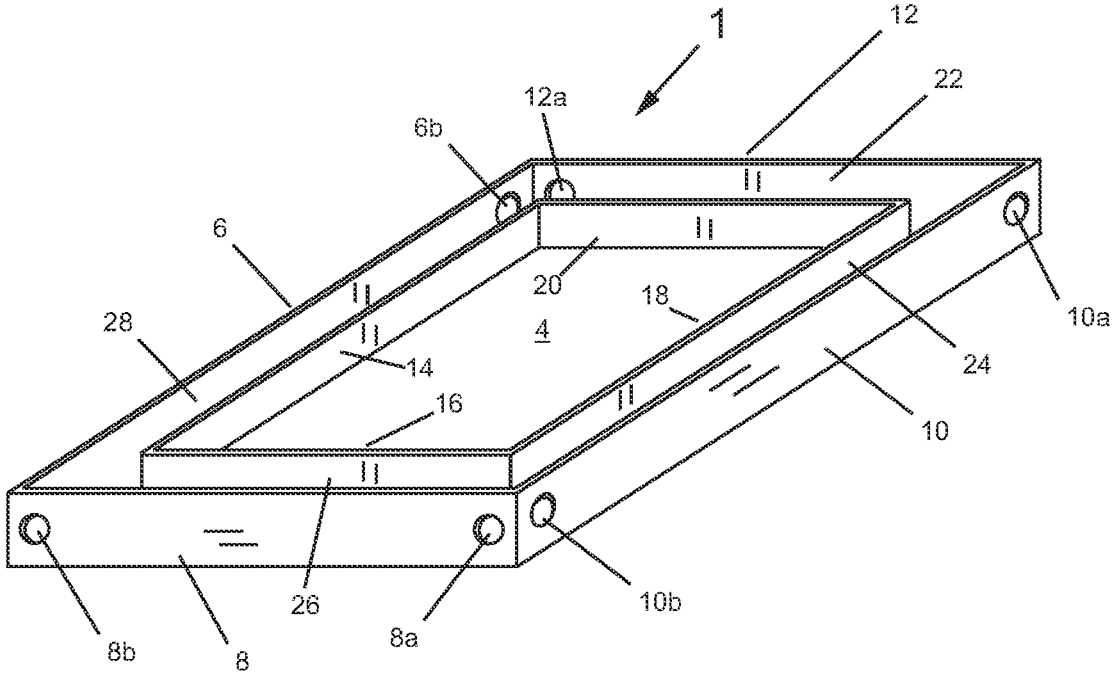
FIG. 3 shows a bottom, front, and left perspective view of the first device for use in accordance with an embodiment of the present invention.
Figure 4:
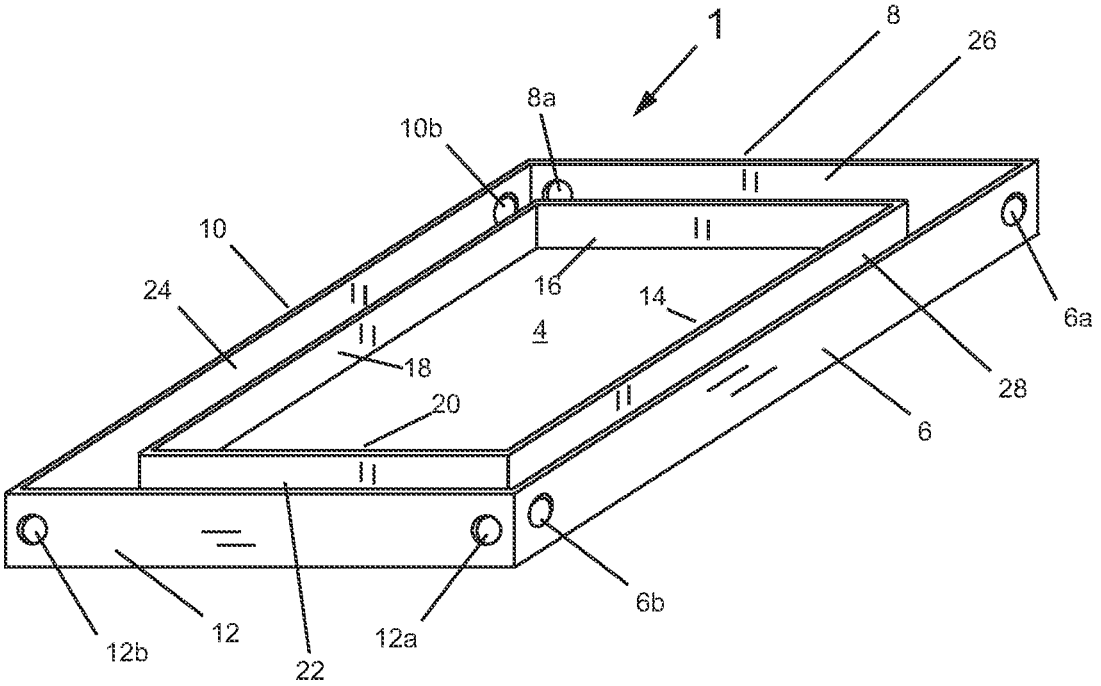
FIG. 4 shows a bottom, rear, and right perspective view of the first device for use in accordance with an embodiment of the present invention.

FIG. 1 shows a top, front, and right perspective view of a first device 1 for use in accordance with an embodiment of the present invention. FIG. 2 shows a top, rear, and left perspective view of the first device 1. FIG. 3 shows a bottom, front, and left perspective view of the first device 1. FIG. 4 shows a bottom, rear, and right perspective view of the first device 1.

Referring to FIGS. 1-4, the first device 1 includes a top member 2, an opening 4 which may be rectangular, outside members 6, 8, 10, and 12, and inside members 14, 16, 18, and 20. Member 8 has openings 8*a* and 8*b* and member 6 has openings 6*a* and 6*b* as shown in FIG. 1. Member 10 has openings 10*a* and 10*b* and member 12 has openings 12*a* and 12*b* as shown in FIG. 2.

Each of the openings of 6*a-b*, 8*a-b*, 10*a-b*, and 12*a-b*, is typically the same size and shape, as each of the other openings of 6*a-b*, 8*a-b*, 10*a-b*, and 12*a-b*. Each of the openings 6*a-b*, 8*a-b*, 10*a-b*, and 12*a-b* is typically circular and has an inner diameter.

Openings 6*b* and 10*a* are aligned with each other such that an elongated straight bar, cylinder or member having an outer diameter of less than the diameter of each of the openings 10*a* and 6*b*, is configured to be slid into opening 10*a*, pass into channel 22 (shown in FIG. 3) between outside member 12 and inside member 20 and then out through opening 6*b*. The elongated straight bar, cylinde 3*r* or member is also configured to go through the reverse way, i.e. slid into opening 6*b*, pass into channel 22 and then out through opening 10*a*.

Openings 6*a* and 10*b* are aligned with each other such that an elongated straight bar, cylinder or member having an outer diameter of less than the diameter of each of the openings 10*b* and 6*a*, is configured to be slid into opening 10*b*, pass into channel 26 between outside member 8 and inside member 16 and then out through opening 6*a*. The elongated straight bar, cylinder or member is also configured to go through the reverse way, i.e. slid into opening 6*a*, pass into channel 26 and then out through opening 10*b*.

Similarly, openings 12*a* and 8*b* (as shown in FIG. 3) are aligned with each other such that an elongated straight bar, cylinder or member having an outer diameter of less than the diameter of each of the openings 12*a* and 8*b*, is configured to be slid into opening 12*a*, pass into channel 28 (shown in FIG. 3) between outside member 6 and inside member 14 and then out through opening 8*b*. The elongated straight bar, cylinder or member is also configured to go through the reverse way, i.e. slid into opening 8*b*, pass into channel 28 and then out through opening 12*a*.

Similarly, openings 12*b* and 8*a* (as shown in FIG. 4) are aligned with each other such that an elongated straight bar, cylinder or member having an outer diameter of less than the diameter of each of the openings 12*b* and 8*a*, is configured to be slid into opening 12*b*, pass into channel 24 (shown in FIG. 4) between outside member 24 and inside member 18 and then out through opening 8*a*. The elongated straight bar, cylinder or member is also configured to go through the reverse way, i.e. slid into opening 8*a*, pass into channel 24 and then out through opening 12*b*.

The device 1 may be made entirely of a hard rigid material, such as a hard plastic, or a hard metal material.

The device 1 may have a height H1, shown in FIG. 1, which may be about one and one eighth inches.

The distance D1, shown in FIG. 1, between the outer surfaces of wall or member 18 and parallel wall or member 10 may be about one and three eighths inches. Similarly the distance between outer surfaces of wall or member 14 and parallel wall or surface 6; the distance between outer surfaces of wall or member 20 and parallel wall or member 12; and the distance between outer surfaces of wall or member 8 and parallel wall or member 16 may be D1.

The device 1 may have a width W1 and a length L1.

The width W1 and the length L1 may be various sizes. The length L1 may be eight inches while the width W1 may be six inches. The length L1 may be ten inches while the width W1 may be four or six inches. The length L1 may be twelve inches while the width W1 may be four, six, or eight inches. The length L1 may be fourteen inches while the width W1 may be six or fourteen inches. The length L1 may be sixteen inches while the width W1 may be sixteen inches. The length L1 may be eighteen inches while the width W1 may be eighteen inches.

Other combinations for length L1 and width W1 are contemplated in other embodiments.

Figure 5:
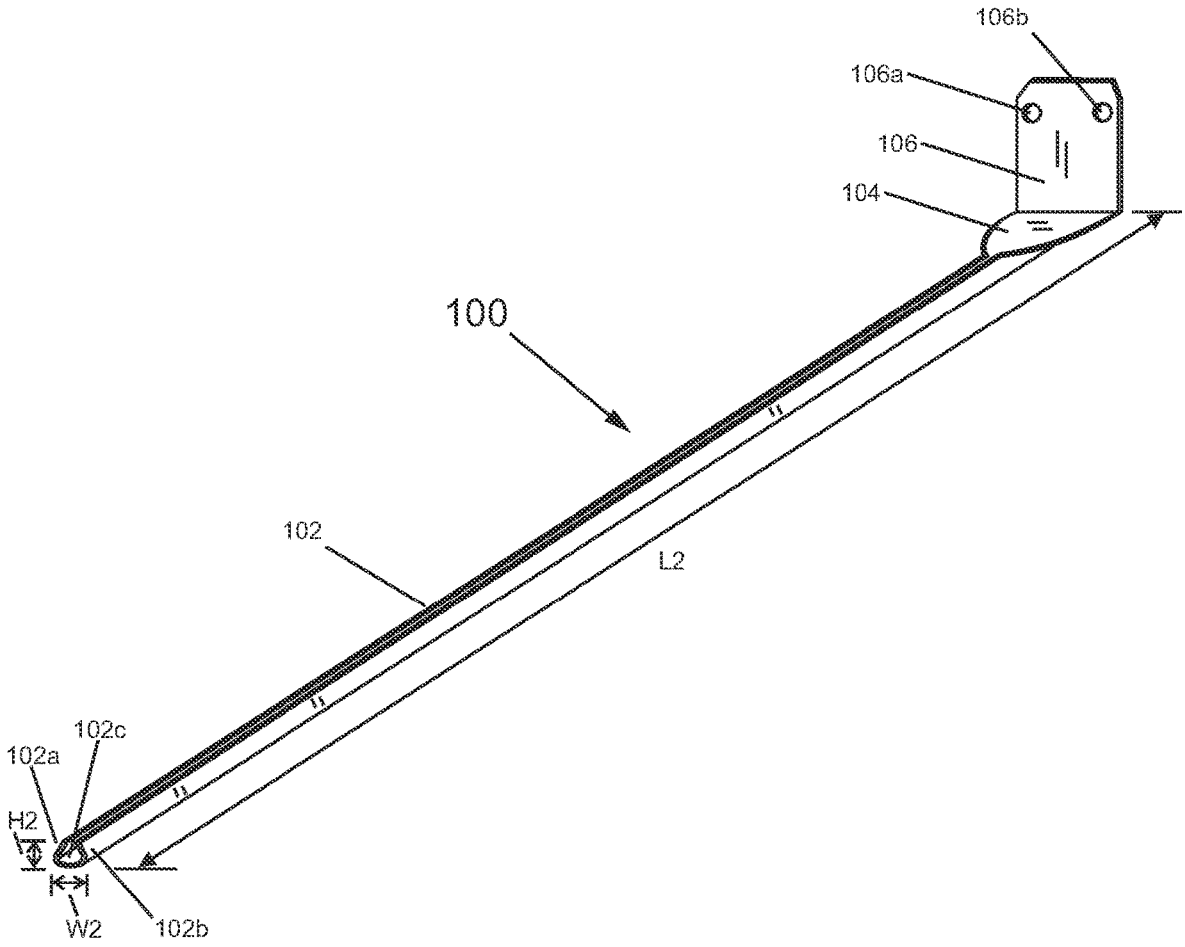
FIG. 5 shows a top, front, and right perspective view of the second device for use in accordance with an embodiment of the present invention.

FIG. 5 shows a top, front, and right perspective view of the second device 100 for use in accordance with an embodiment of the present invention. The second device 100 may include a rail 102 integrated with and fixed to an intermediate piece 104 and a plate 106, to be used as a bracket. The second device 100 may be made entirely of solid metal, such as steel, brass, or any other solid metal that metal brackets are typically made of.

The intermediate piece 104 may be at a right angle with respect to the plate 106. The plate 106 may also be at a right angle with respect to the rail 102. The rail 102 may be a metal piece or plate that has been bent into a U-shape or horseshoe shape with the top ends of the U-shape bent in towards each other. The U-shape or horseshoe shape may have a width W2 and a height H2 as shown in FIG. 5. The U-shape of the rail 102 and the rail 102 includes outer walls 102*a* and 102*b*, and bottom wall 102*c*.

The second device 100 may have a length L2 is typically configured to be greater than the length L1 of the first device 1. The plate 106 has openings 106*a* and 106*b* for inserting fasteners, such as screws or nails in order to fix the second device or bracket 100 to, for example, a piece of lumber, stud, wood beam or wood two by four.

Figure 6:
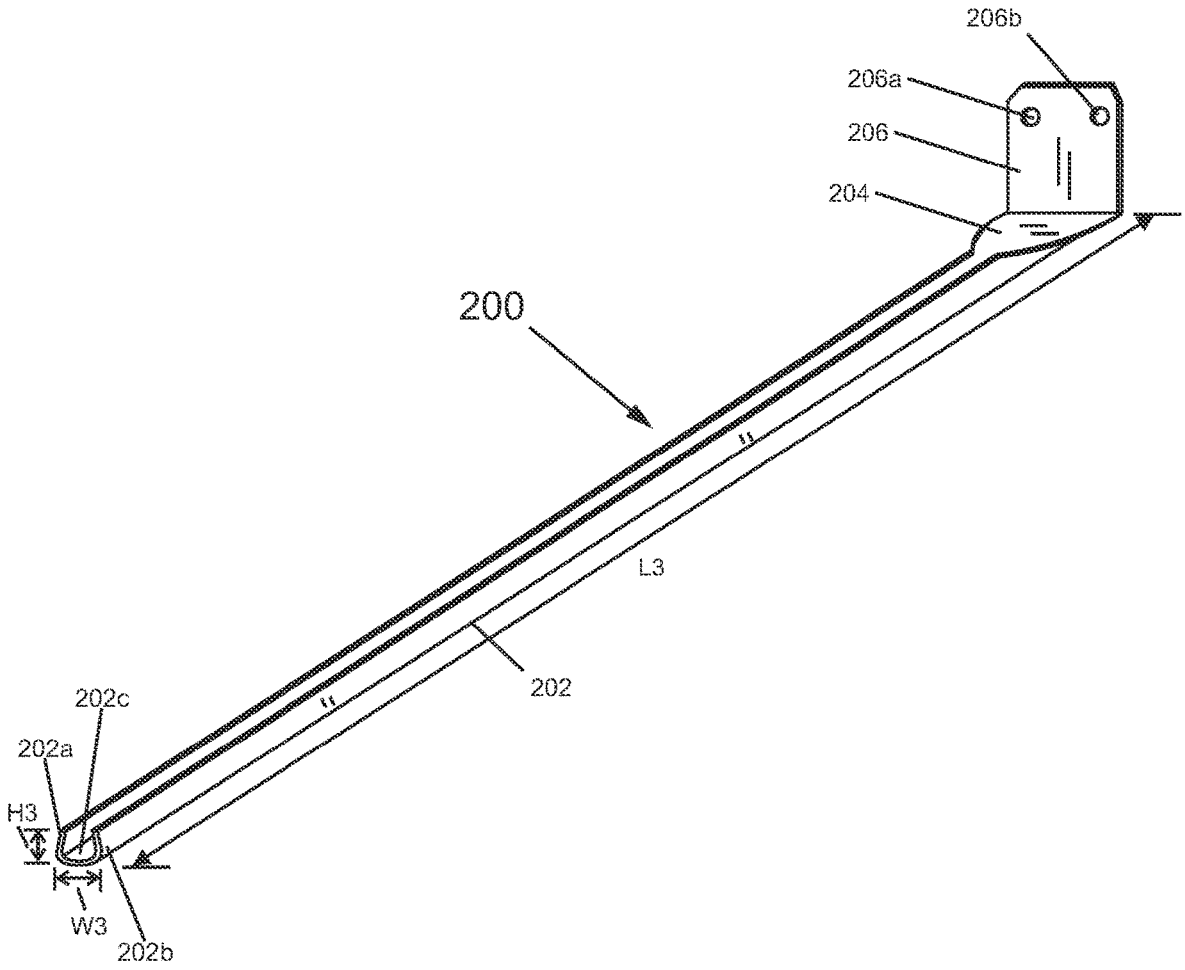
FIG. 6 shows a top, front, and right perspective view of the third device for use in accordance with an embodiment of the present invention.

FIG. 6 shows a top, front, and right perspective view of the third device 200 for use in accordance with an embodiment of the present invention. The third device 200 may include a rail 202 integrated with and fixed to an intermediate piece 204 and a plate 206, to be used as a bracket. The second device 200 may be made entirely of solid metal, such as steel, brass, or any other solid metal that metal brackets are typically made of.

The intermediate piece 204 may be at a right angle with respect to the plate 206. The plate 206 may also be at a right angle with respect to the rail 202. The rail 202 may be a metal piece or plate that has been bent into a U-shape or horseshoe shape with the top ends of the U-shape bent in slightly towards each other, but typically less so that in FIG. 6 for the second device 100. The U-shape or horseshoe shape may have a width W3 and a height H3 as shown in FIG. 6. The U-shape of the rail 202 and the rail 202 includes outer walls 202*a* and 202*b*, and bottom wall 202*c*.

The U-shape or horseshoe shape width and height and shape of the rail 202, and the walls 202*a-c* of FIG. 6 is such that the rail 102 (and the walls 102*a-c*) of FIG. 5 can slide into the U-shape of the rail 202 of FIG. 6. When the rail 102 has at least partially slid into the rail 202, at least a portion of both the walls 102*a* and 102*b* are between the walls 202*a* and 202*b*, and the wall 102*c* is on top of the wall 202*c*, and typically the rails 102 and 202 are configured so that the walls 102*a* and 102*b* do not extend above the walls 202*a* and 202*b*, when the rail 102 has slid into the rail 202. In addition, when the rail 102 has at least partially slid into the rail 202, the rail 102 is typically parallel to the rail 202, and the rail 202 holds the rail 102 in an orientation which is parallel to the rail 202 or substantially parallel to the rail 102.

The third device 200 may have a length L3 is typically configured to be about the length L2 of the second device 100. The plate 206 has openings 206*a* and 206*b* for inserting fasteners, such as screws or nails in order to fix the third device or bracket 200 to, for example, a piece of lumber, stud, wood beam or wood two by four.

Figure 7:
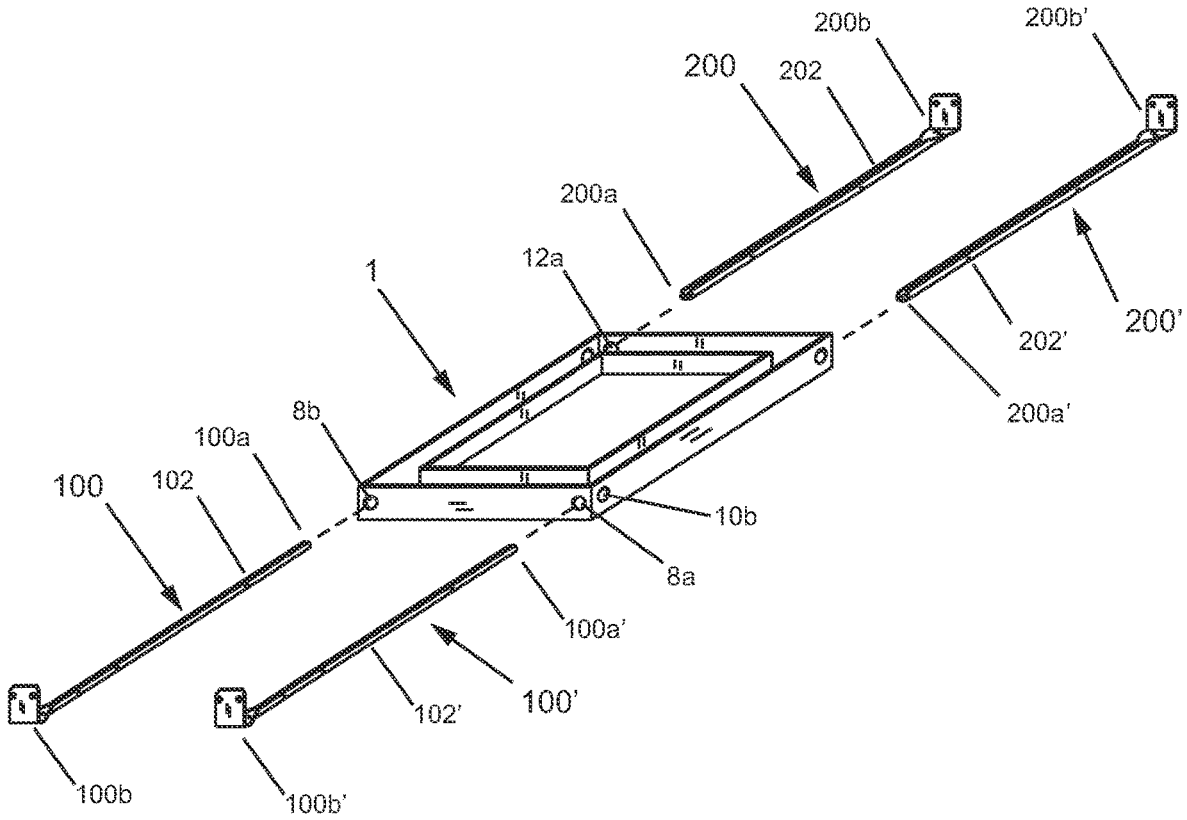
FIG. 7 shows a bottom, front, and left perspective view of the first device, along with perspective views of the second device and a twin second device, and the third device and a twin third device, in a disassembled state.

FIG. 7 shows a bottom, front, and left perspective view of the first device 1, along with perspective views of the second device 100 and a twin second device 100', and the third device 200 and a twin third device 200', in a disassembled state. The second device 100 and the twin second device 100' are identical and/or substantially the same. The third device 200 and the twin third device 200' are identical and/or substantially the same.

The second device 100 has an end 100*a* and an end 100*b*. The twin second device 100' has an end 100*a'* and an end 100*b'* The third device 200 has an end 200*a* and an end 200*b*. The twin third device 200' has an end 200*a'* and an end 200*b'*.

The second device 100, the second twin device 100', the third device 200, and the third twin device 200' may be at least partially inserted into the first device 1 so that the ends 100*a*, 100*a'*, 200*a*, and 200*a'* are inserted into the openings 8*b*, 8*a*, 12*a*, and 12*b* (shown in FIG. 4, not shown in FIG. 7), and thereafter the rail 102 may be at least partially inserted into the rail 202, and the rail 102' may be at least partially inserted into the rail 202', such that an overlapping combination of rail 102 within rail 202 lies within channel 28 and an overlapping combination of rail 102' within rail 202' lies within channel 24.

Figure 8:
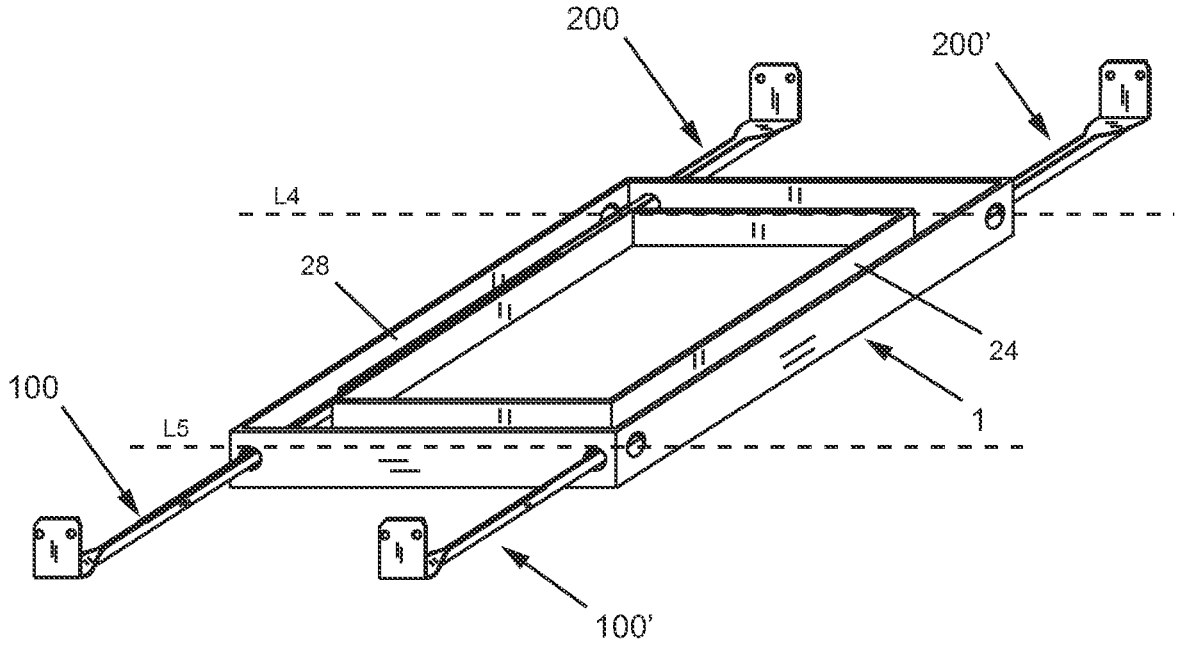
FIG. 8 shows a bottom, front and left perspective view of the first device along with the second device, the twin second device, the third device, and the twin third device shown partially inserted into the first device.

FIG. 8 shows a bottom, front and left perspective view of the first device 1 along with the second device 100, the twin second device 100', the third device 200, and the twin third device 200' shown partially inserted into the first device 1, with the rail 102 at least partially overlapping and in at least partially within and held by the rail 202 within the channel 28; and with the rail 102' at least partially overlapping and in at least partially within and held by the rail 202', within the channel 24.

Figure 9:
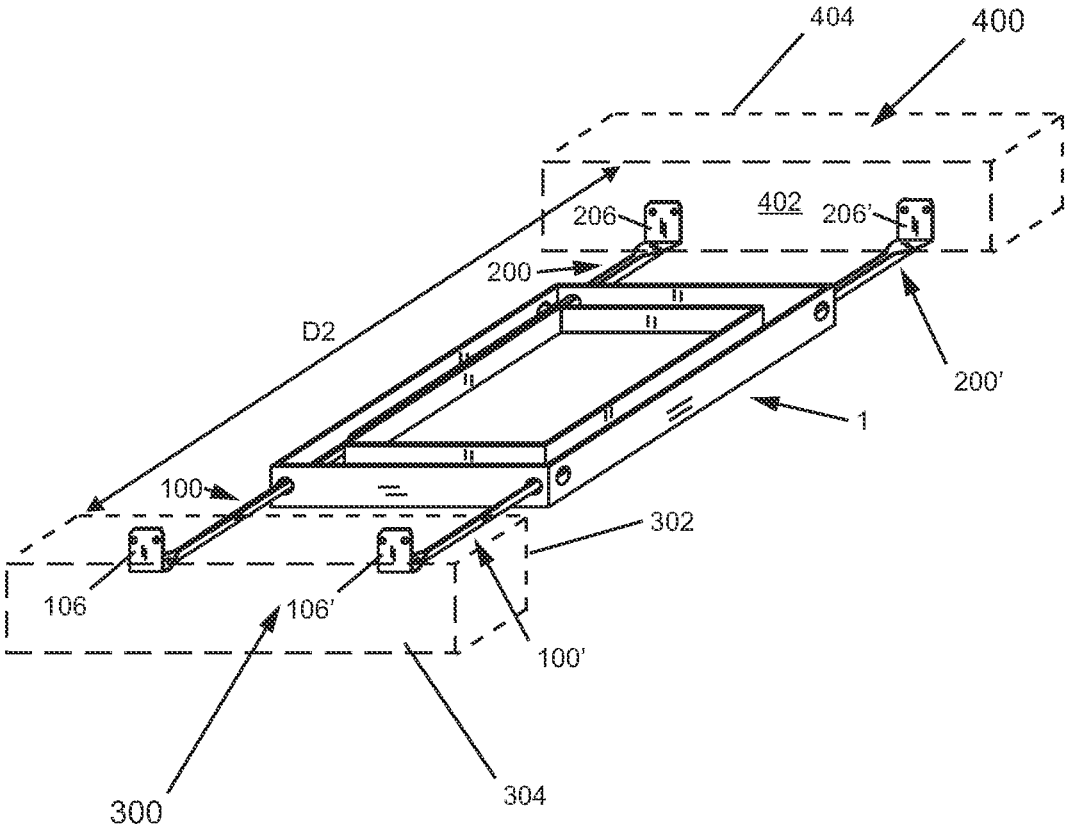
FIG. 9 shows a bottom, front, and left perspective view of the first device along with the second device, the twin second device, the third device, and the twin third device shown partially inserted into the first device, and with the second device and the twin second device shown fixed to a first beam or first member, and with the third device, and the twin third device shown fixed to a second beam or second member.

FIG. 9 shows a bottom, front, and left perspective view of the first device 1 along with the second device 100, the twin second device 100', the third device 200, and the twin third device 200' shown partially inserted into the first device 1, and with the second device 100 and the twin second device 100' shown fixed to an inside surface 302 of a first beam 300 or first member, and with the third device 200, and the twin third device 200' shown fixed to an inside surface 402 of a second beam or second member 400. The first beam 300 may include an outer surface 304; and the second beam 400 may include an outer surface 404. The beams 300 and 400 may be lumber, wood, and/or wood two by fours, such as used as framing in a house or building. The beams 300 and 400 are typically parallel to substantially parallel to each other and are separated by a distance of D2 shown in FIG. 9. However, this distance may be different in different buildings, and that is one reason why one embodiment of the present invention is useful, because the devices 100 and 200 (and the devices 100' and 200') can be slid with respect to each other, while still overlapping substantially to adjust to different distances D2.

In at least one embodiment, instead of inserting ends 100*a* and 100*a'* of rails 102 and 102' into openings 8*b* and 8*a*, respectively, the ends 100*a* and 100*a'* of rails 102 and 102' may be inserted into openings 10*b* and 10*a* respectively, i.e. perpendicular to the configuration of FIGS. 7-9. In such a configuration, the ends 200*a* and 200*a'* of rails 202 and 202' are inserted into openings 6*a* and 6*b*, respectively. Then rail 102 is at least partially inserted into rail 202, and held by rail 202 within channel 26, and rail 102' is at least partially inserted into rail 202', and held by rail 202' within channel 22.

It is contemplated, in at least one embodiment, that in addition to second device 100, second twin device 100', third device 200, and third twin device 200', a duplicate set of four devices (i.e. devices identical to 100, 100', 200, and 200') may be provided and placed in an orientation perpendicular to the orientation of the device 100, 100', 200, and 200', with respect to the first device 1. For example, as shown in FIG. 8, a device identical to device 100 may be inserted along line L5 through opening 6*a*, and a device identical to device 200 may be inserted along line L5 through opening 10*b*, and then a rail of the device identical to device 100 may be inserted into a rail of the device identical to device 200, in the channel 26. Similarly, a device identical to device 100' may be inserted along line L4 through opening 6*b*, and a device identical to device 200' may be inserted along line L4 through opening 10*a*, and then a rail of the device identical to device 100' may be inserted into a rail of the device identical to device 200', in the channel 22.

For a simultaneous embodiment, the width and height of the U-shaped rails needs to be small enough to allow rails along lines L5 and L4 perpendicular to the rails 100 and 200 and 100' and 200' as shown in FIG. 8. Typically, in this simultaneous embodiment, each of the heights H2 and H3 of the rails 102 and 202 should be less than half the diameter of each of the circular openings 6*a-b*, 8*a-b*, 10*a-b*, and 12*a-b*.

The first device 1 may be an HVAC (heating, ventilation, and air conditioning) outlet box. One or more embodiments of the present invention are configured to fix the first device 1 typically to framing, wood beams or studs used for walls and ceilings in buildings.

The first devices 1 and the devices 100, 200, 100' and 200' and similar or identical devices may be useful in both residential buildings and in commercial buildings. The adjustable nature of the combination apparatus of first device 1 and the second device 100, third device 200, twin device 100' and twin device 200', and/or further devices allows easy placement, and saves time, since it does not require additional measurements other than location.

The four sliding arms or rails 102, 202, 102', 202' adjust to a desired distance D2, and in at least one embodiment, they are configured to be adjusted between fourteen and twenty-two inches. The typically rectangular shape of the first device 1 is configured to be adjusted parallel to a wall, making the aesthetics visible. The versatility of one or more embodiments of the present invention allows it to be placed parallel or perpendicular to the beams, such as beam 300 and/or beam 400.

The first device 1 is typically made of ABS (Acrylonitrile Butadiene Styrene, which is a tough very durableic) with a line that reinforces the structure. The four sliding arms or rails 102, 202, 102' and 202' may be configured to be fixed to the first device 1, such as with a wooden or metal ring to the first device 1.

Figure 10:
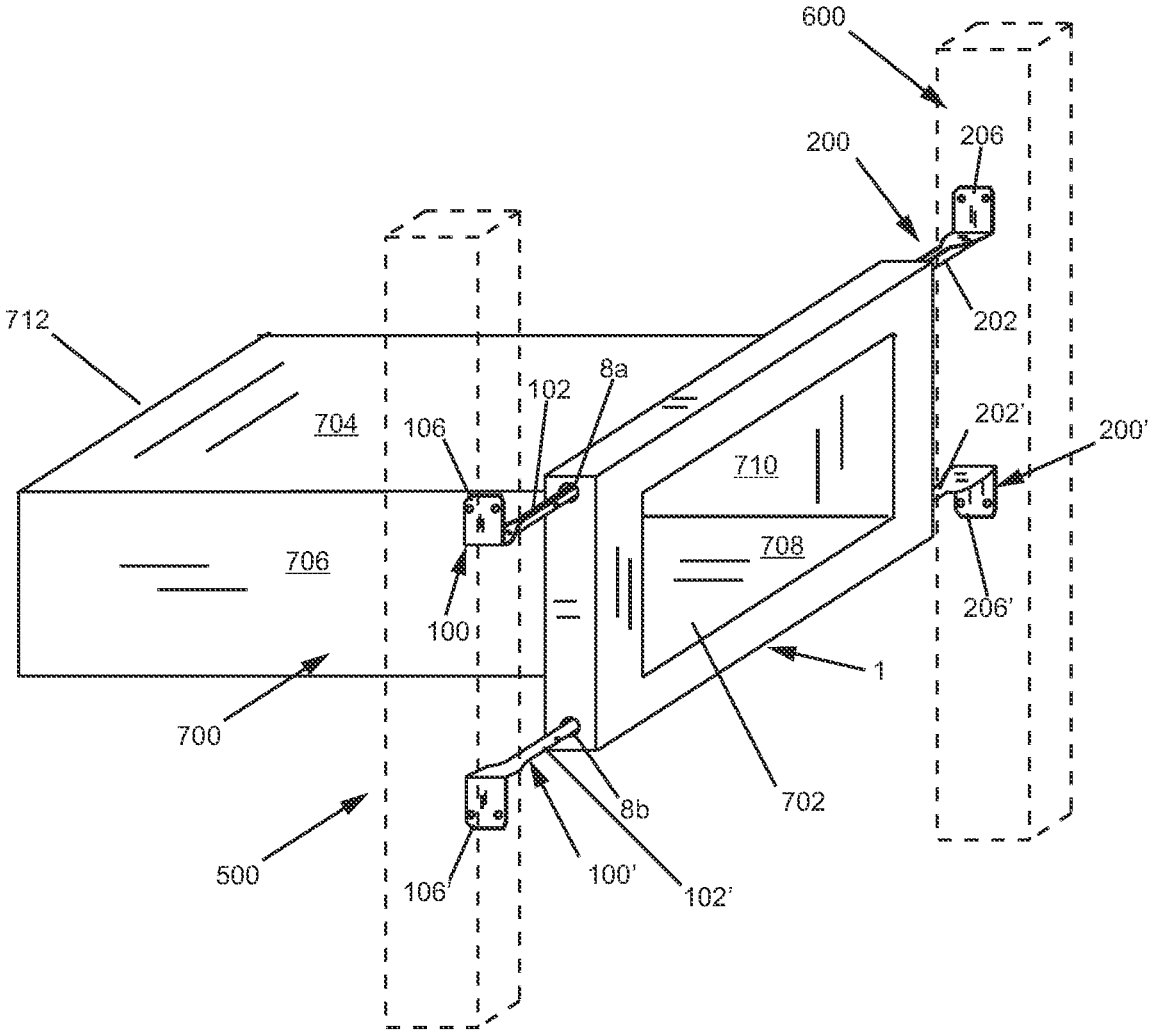
FIG. 10 shows a top, front, and left perspective view of the first device fixed by the second and third devices, and twin second and third devices to two beams, and with a heating or air conditioning duct and/or piping shown connected to the first device.

FIG. 10 shows a top, front, and left perspective view of the first device 1 fixed by the second device 100 and twin second device 100' to a wood beam, stud, or framing 500, which is shown in dashed lines, and fixed by the third device 200 and twin third device 200' to a wood beam, stud, or framing 600. In FIG. 10, the second device 100 is inserted at least partially into the third device 200; and the twin second device 100' is inserted at least partially into the twin device 200' similarly or identically to as shown and described with reference to FIG. 8.

FIG. 10 shows at least part of a heating or air conditioning duct and/or piping 700. The duct may include top 704, sides 710 and 706, and bottom 708. The duct may include an entrance opening 702 which leads into the duct 700 and an exit opening 712, which may lead to other ducts, piping, and/or other heating and/or air conditioning system equipment. The duct 700 is shown in a simplified shortened form for descriptive purposes.

The plates 106 and 106' of the corresponding devices 100 and 106' may be fixed to an inside surface of the beam 500 by screws and/or nails. Similarly and/or identically, the plates 206 and 206' of the corresponding devices 200 and 200' may be fixed to an inside surface of the beam 600 by screws and/or nails.

It is preferred that the devices 100, 100', 200, and 200' be configured so that when at least part of the rail 102 of device 100 is within the rail 202 of the device 200, the combination of the devices 100 and 200 can rotate and/or change orientation with respect to the device 1, while the devices 100 and 200 are at least partially in the device 1, as in FIGS. 8, 9, and 10. Similarly, and/or identically, when at least part of the rail 102' of the device 100' is within the rail 202' of the device 202', the combination of devices 100' and 200' can rotate and/or change orientation with respect to the device 1, while the devices 100' and 200' are at least partially in the device 1, as in FIGS. 8, 9, and 10. For example, as shown in FIG. 10, the devices 100 and 200 may be oriented with respect to the device 1, such that the plates 106 and 206 project upwards, perpendicularly to the rails 102 and 202, respectively, while the devices 100' and 200' may be oriented with respect to the device 1, such that the plates 106' and 206' project downwards, perpendicularly to the rails 102' and 202', respectively, opposite from the direction of projection of the plates 106 and 206, respectively. By configuring devices 1, 100, 200, 100', and 200' to allow for rotation or change of the orientation of plates 106, 206, 106', and 206' with respect to the device 1, this allows the device 1 to be more easily mounted in different environments, such as to different wood beams, studs or framing. However, it is preferred that the plates 106 and 106' be oriented and fixed (such as by screws to beams 500 and 600 through holes in plates 106 and 106', respectively) so that they project outwards in opposite directions and that the plates 206 and 206' be oriented and fixed (such as by screws to beams 500 and 600, through holes in plates 206 and 206', respectively) so that they project outwards in opposite directions as shown in FIG. 10, because, this provides a stronger, more balanced mounting.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first device having first and second openings, and a first track between the first and second openings of the first device;

a second device, which includes an elongated rail;

a third device, which includes an elongated rail;

wherein the first device is configured so that a first end of the rail of the second device is configured to be inserted into the first opening of the first device, so that a majority of the rail of the second device lies within the first track of the first device, while a first end of the rail of the third device is configured to be inserted into the second opening of the first device, so that a majority of the rail of the third device lies with the first track of the first device and interlocks with the rail of the second device;

wherein the first device has a length and a width;

wherein the first device has a first outer wall and a first inner wall which is parallel to the first outer wall;

wherein the first outer wall runs the entire length of the first device; and wherein the first track is between the first inner wall and the first outer wall;

further comprising:

a fourth device, which includes an elongated rail; and a fifth device, which includes an elongated rail;

wherein the first device has third and fourth openings;

wherein the first device has a second track between the third and fourth openings of the first device;

wherein the first track and the second track are perpendicular to each other:

wherein the first device is configured so that a first end of the rail of the second device is configured to be inserted into the first opening of the first device, so that a majority of the rail of the second device lies within the first track of the first device, while a first end of the rail of the third device is configured to be inserted into the second opening of the first device, so that a majority of the rail of the third device lies within the first track of the first device and interlocks with the rail of the second device;

wherein the first device is configured so that a first end of the rail of the fourth device is configured to be inserted into the third opening of the first device, so that a majority of the rail of the fourth device lies within the second track of the first device, while a first end of the rail of the fifth device is configured to be inserted into the fourth opening of the first device, so that a majority of the rail of the fifth device lies with the second track of the first device and interlocks with the rail of the fourth device; and wherein the majority of the rail of the third device lies within the first track of the first device and interlocks with the rail of the second device, while the majority of the rail of the fifth device lies within the second track of the first device and interlocks with the rail of the fourth device.

2. The apparatus of claim 1 wherein the second device includes a plate fixed to a second end of the rail of the second device opposite the first end of the rail of the second device; and wherein the third device includes a plate fixed to a second end of the rail of the third device opposite the first end of the rail of the third device.

3. The apparatus of claim 2 wherein the plate of the second device has an opening through which a fastener is configured to be inserted to fix the plate of the second device to a member;

wherein the plate of the third device has an opening through which a fastener is configured to be inserted to fix the plate of the second device to a member.

4. The apparatus of claim 1 wherein the first device includes a third track and a fourth track;

wherein the third track is between fifth and sixth openings of the first device;

wherein the fourth track is between seventh and eighth openings of the first device;

wherein the third track is parallel to the first track and perpendicular to the second track;

wherein the fourth track is perpendicular to the third track;

wherein the first device is configured so that a first end of the rail of the second device is configured to be inserted into the fifth opening of the first device, so that a majority of the rail of the second device lies within the third track of the first device, while a first end of the rail of the third device is configured to be inserted into the sixth opening of the first device, so that a majority of the rail of the third device lies with the third track of the first device and interlocks with the rail of the second device, while a first end of the rail of the fourth device is configured to be inserted into the seventh opening of the first device, so that a majority of the rail of the fourth device lies within the fourth track of the first device, while a first end of the rail of the fifth device is configured to be inserted into the eighth opening of the first device so that a majority of the rail of the fifth device lies within the fourth track of the first device and interlocks with the rail of the fourth device.

5. The apparatus of claim 1 wherein the first device has a rectangular periphery.

6. The apparatus of claim 1 wherein the first device is made of plastic; and the second, third, fourth, and fifth devices are made of metal.

7. The apparatus of claim 1 wherein the fourth device includes a plate fixed to a second end of the rail of the fourth device opposite the first end of the rail of the fourth device; and wherein the fifth device includes a plate fixed to a second end of the rail of the fifth device opposite the first end of the rail of the fifth device.

8. The apparatus of claim 7 wherein wherein the plate of the fourth device has an opening through which a fastener is configured to be inserted to fix the plate of the fourth device to a member; and wherein the plate of the fifth device has an opening through which a fastener is configured to be inserted to fix the plate of the fifth device to a member.

9. The apparatus of claim 1 wherein the first device includes second, third and fourth inner walls;

wherein the first, second, third, and fourth inner walls of the first device define a rectangular opening in the first device; and wherein the rectangular opening of the first device is configured to align with an opening leading into a heating, ventilation, and air conditioning duct.

10. A method comprising the steps of:

fixing a first device to a first structural member and a second structural member by use of second and third devices, respectively;

wherein the first device has first and second openings, and a first track between the first and second openings of the first device;

wherein the second device includes an elongated rail;

wherein the third device includes an elongated rail;

wherein the first device is configured so that a first end of the rail of the second device is configured to be inserted into the first opening of the first device, so that a majority of the rail of the second device lies within the first track of the first device, while a first end of the rail of the third device is configured to be inserted into the second opening of the first device, so that a majority of the rail of the third device lies with the first track of the first device and interlocks with the rail of the second device;

wherein the first device has a length and a width;

wherein the first device has a first outer wall and a first inner wall which is parallel to the first outer wall;

wherein the first outer wall runs the entire length of the first device; and wherein the first track is between the first inner wall and the first outer wall;

further comprising:

simultaneously fixing the first device to a third structural member and a fourth structural member by use of fourth and fifth devices, respectively;

wherein the fourth device, which includes an elongated rail;

wherein the fifth device, which includes an elongated rail;

wherein the first device has third and fourth openings;

wherein the first device has a second track between the third and fourth openings of the first device;

wherein the first track and the second track are perpendicular to each other;

wherein the first device is configured so that a first end of the rail of the second device is configured to be inserted into the first opening of the first device, so that a majority of the rail of the second device lies within the first track of the first device, while a first end of the rail of the third device is configured to be inserted into the second opening of the first device, so that a majority of the rail of the third device lies with the first track of the first device and interlocks with the rail of the second device;

wherein the first device is configured so that a first end of the rail of the fourth device is configured to be inserted into the third opening of the first device, so that a majority of the rail of the fourth device lies within the second track of the first device, while a first end of the rail of the fifth device is configured to be inserted into the fourth opening of the first device, so that a majority of the rail of the fifth device lies with the second track of the first device and interlocks with the rail of the fourth device; and wherein the majority of the rail of the third device lies within the first track of the first device and interlocks with the rail of the second device, while the majority of the rail of the fifth device lies within the second track of the first device and interlocks with the rail of the fourth device.

11. The method of claim 10 wherein the second device includes a plate fixed to a second end of the rail of the second device opposite the first end of the rail of the second device; and wherein the third device includes a plate fixed to a second end of the rail of the third device opposite the first end of the rail of the third device.

12. The method of claim 11 wherein the plate of the second device has an opening through which a fastener is configured to be inserted to fix the plate of the second device to a member;

wherein the plate of the third device has an opening through which a fastener is configured to be inserted to fix the plate of the second device to a member.

13. The method of claim 10 wherein the first device includes a third track and a fourth track;

wherein the third track is between fifth and sixth openings of the first device;

wherein the fourth track is between seventh and eighth openings of the first device;

wherein the third track is parallel to the first track and perpendicular to the second track;

wherein the fourth track is perpendicular to the third track;

wherein the first device is configured so that a first end of the rail of the second device is configured to be inserted into the fifth opening of the first device, so that a majority of the rail of the second device lies within the third track of the first device, while a first end of the rail of the third device is configured to be inserted into the sixth opening of the first device, so that a majority of the rail of the third device lies with the third track of the first device and interlocks with the rail of the second device, while a first end of the rail of the fourth device is configured to be inserted into the seventh opening of the first device, so that a majority of the rail of the fourth device lies within the fourth track of the first device, while a first end of the rail of the fifth device is configured to be inserted into the eighth opening of the first device so that a majority of the rail of the fifth device lies within the fourth track of the first device and interlocks with the rail of the fourth device.

14. The method of claim 10 wherein the first device has a rectangular periphery.

15. The method of claim 10 wherein the first device is made of plastic; and the second, third, fourth, and fifth devices are made of metal.

16. The method of claim 10 wherein the fourth device includes a plate fixed to a second end of the rail of the fourth device opposite the first end of the rail of the fourth device; and wherein the fifth device includes a plate fixed to a second end of the rail of the fifth device opposite the first end of the rail of the fifth device.

17. The method of claim 16 wherein wherein the plate of the fourth device has an opening through which a fastener is configured to be inserted to fix the plate of the fourth device to a member; and wherein the plate of the fifth device has an opening through which a fastener is configured to be inserted to fix the plate of the fifth device to a member.

18. The method of claim 10 wherein the first device includes second, third and fourth inner walls;

wherein the first, second, third, and fourth inner walls of the first device define a rectangular opening in the first device; and further comprising:

aligning the rectangular opening in the first device with an opening leading into a heating, ventilation, and air conditioning duct.

* * * * *